US005765074A

United States Patent [19]

Yasui et al.

[11] Patent Number: 5,765,074

[45] Date of Patent: Jun. 9, 1998

[54] TRANSFER DEVICE AND IMAGE FORMING APPARATUS USING SAID TRANSFER DEVICE

[75] Inventors: Masato Yasui; Kazunobu Maekawa, both of Toyokawa, Japan

[73] Assignee: Minolta Co., Ltd., Osaka, Japan

[21] Appl. No.: 668,853

[22] Filed: Jun. 24, 1996

[30] Foreign Application Priority Data

Jun. 30, 1995 [JP] Japan ..... 7-188174

[51] Int. Cl.[6] ..... G03G 15/18

[52] U.S. Cl. ..... 399/66; 399/49

[58] Field of Search ..... 355/208, 271, 355/273, 274, 246, 319; 399/49, 66, 364

[56] References Cited

U.S. PATENT DOCUMENTS 4,347,299 8/1982 Ozawa et al. ..... 355/246 X 5,229,816 7/1993 Fujimoto et al. ..... 355/208

5,296,903 3/1994 Suzuki et al. ..... 355/271

5,428,434 6/1995 Hirao ..... 355/208 X 5,548,378 8/1996 Ogata et al. ..... 355/208

*Primary Examiner*—Arthur T. Grimley

*Assistant Examiner*—Sophia S. Chen

*Attorney, Agent, or Firm*—Burns, Doane, Swecker & Mathis, LLP

[57] ABSTRACT

The present invention relates to an image forming apparatus having a first forming device forming a first toner image on a first surface of a sheet, a second forming device forming a second toner image on a second surface of the sheet, a detecting device detecting the amount of adhered toner on the first surface of the sheet, a setting device setting an forming output according to the amount of adhered toner detected by detecting device, and inputting device inputting the forming output to the second forming device in order to form the second toner image by the settled forming output. The object of the present invention is to provide a reliable image forming.

14 Claims, 4 Drawing Sheets

TRANSFER DEVICE AND IMAGE FORMING APPARATUS USING SAID TRANSFER DEVICE

BACKGROUND OF THE INVENTION

1. Field of the Invention

The present invention relates to a transfer device for use in image forming apparatuses of the electrophotographic type provided with a function to print on both sides of a sheet, and an image forming apparatus using said transfer device. More specifically, the present invention relates to a transfer device capable of controlling electrostatic transfer output level and electrostatic adhesion output level when printing on a second surface of a sheet, and an image forming apparatus using said transfer device.

2. Description of the Related Art

Image forming apparatuses of the electrophotographic type provided with a duplex printing function have been proposed, including, for example, duplex printers, duplex copiers, and duplex facsimile apparatuses. In such apparatuses, after a toner image electrostatically transferred to a first surface of a sheet is thermally fused thereon, the sheet is again transported to a transfer position with a second surface as a transfer surface, a toner image is transferred to said second surface and fused thereon, whereupon the sheet is ejected from the apparatus.

Color image forming apparatuses of an electrophotographic type provided with a duplex printing function have been proposed, including, for example, color duplex printers, color duplex copiers, and color duplex facsimile apparatuses. In these apparatuses, after yellow Y, magenta M, cyan C, and black B toner images sequentially formed on the surface of a photosensitive drum are transferred so as to be superimposed one over another on a first surface of a sheet held on a sheet carrying member such as a transfer drum, transfer belt or the like, said sheet is separated from the sheet carrying member and transported to a fixing device for fixing. Then, the sheet is again held on the sheet carrying member so as to have a second surface as a transfer surface and is transported to the transfer position, and toner images of the four colors are sequentially transferred and overlaid one over another in the same manner as for the first surface, the sheet is separated from the sheet carrying member, transported to the fixing device which fuses the toner image to the sheet, and the sheet is ejected from the apparatus.

Conventional color image forming apparatuses of the electrophotographic type provided with a duplex printing function, however, possess certain disadvantages inasmuch as there may be inadequate transfer when a sheet is again held on a sheet carrying member so as to have a second surface as a transfer surface, or toner image transfer to the second surface may be inadequate.

SUMMARY OF THE INVENTION

An object of the present invention is to provide a novel transfer device, and an image forming apparatus which uses said transfer device.

A further object of the present invention is to provide a duplex image forming apparatus capable of accomplishing formation of excellent images by excellent toner image transfer to a second surface (back side) of a sheet. Thus, an object is to suitably control the output of a transfer charger or the like so as to supply to a sheet a transfer charge of a suitable amount, neither excessive nor insufficient.

A still further object of the present invention is to provide a duplex image forming apparatus capable of forming excellent images by preventing inadequate adhesion when a sheet to be printed on a second surface is adhered to a sheet carrying member. Thus, an object is to suitably control the output of an adhesion charger or the like so as to supply to a sheet carrying member a charge of a suitable amount, neither excessive nor insufficient.

In electrophotographic methods, a transfer charger (or transfer roller or the like) supplies a charge to a sheet transported to a transfer position to electrostatically transfer a toner image formed on a photosensitive drum (or intermediate transfer member). In order to form a suitable transfer image on the sheet, a suitable amount of toner, neither excessive nor insufficient, must be adhered to the sheet and, therefore, a suitable amount of charge, neither excessive not insufficient, must be applied to said sheet.

In color electrophotographic methods, a sheet is electrostatically attracted to and maintained on a sheet carrying member by a charge supplied to said sheet carrying member such as a transfer drum or the like from an adhesion charger (or adhesion roller or the like) and transporting a sheet to said sheet carrying member. Toner images of a plurality of colors are transferred onto the sheet by repeatedly transporting said sheet to a transfer position via the sheet carrying member. Therefore, it is imperative that the sheet be held on the sheet carrying member without positional dislocation in order to obtain an excellent transfer image, and to achieve such a transfer image it is necessary to supply a charge of a suitable amount to the sheet carrying member.

A sheet which has been subjected to a thermal fixing process after the toner image has been transferred, i.e., a sheet which has been printed by the electrophotographic method, has reduced moisture content compared to a sheet before said processing. Furthermore, there is disparity of toner adhesion. Therefore, the electrostatic content of the sheet is different than before said processing. The extent of these changes is irregular and differs for each image because the amount of adhered toner is different for each printed image. Moreover, the degree of curling of the sheet is different before and after said processing, and the degree of change of said curling is nonuniform and differs according to the printed image.

When the transfer charger or the like is driven so as to supply a charge to a sheet on a second surface of which a toner image is to be transferred and said output is identical to the output supplied when using an unprocessed sheet, the amount of charge applied to the sheet is less than that applied to an unprocessed sheet due to the aforesaid fluctuations. The amount of said charge also differs depending on the image printed on the first surface. Therefore, a suitable amount of toner cannot be attracted under these conditions, which results deterioration of image quality of the transfer image. When the output of the transfer charger is elevated to counteract the aforesaid disadvantage, said output may become excessive, with the result that the amount of charge supplied to the sheet becomes excessive and causes deterioration of image quality due to discharge-induced disruption of the transferred toner image.

When the adhesion charger or the like is driven so as to supply a charge to a sheet carrying member so as to print on a second surface of a printed sheet and output is used which is identical to the output supplied when using an unprocessed sheet, the degree of curling of the sheet differs from that of an unprocessed sheet, and the extent of such curling of the sheet differs in accordance with the image printed on a first surface of the sheet so as to prevent good adhesion and result in inadequate adhesion and positional dislocation.

When the output of the adhesion charger is elevated to counteract the aforesaid disadvantage, said output may become excessive, with the result that the amount of charge supplied to the sheet carrying member becomes excessive and produces an excessive adhesion force which results in positional dislocation.

An object of the present invention is to provide a duplex image forming apparatus capable of forming excellent images by accomplishing excellent toner image transfers to a second surface of a sheet. Thus, an object is to suitably control the output of a transfer charger or the like so as to supply a suitable amount of transfer charge, neither excessive nor inadequate, to a sheet.

Furthermore, an object of the present invention is to provide a duplex image forming apparatus capable of forming excellent images by preventing inadequate adhesion when adhering a sheet on a sheet carrying member so as to print on a second surface (back side) of said sheet. Thus, an object is to suitably control the output of an adhesion charger or the like so as to supply a suitable amount of adhesion charge, neither excessive nor inadequate, to a sheet carrying member.

DETAILED DESCRIPTION OF THE PREFERRED EMBODIMENTS

Figure 1:
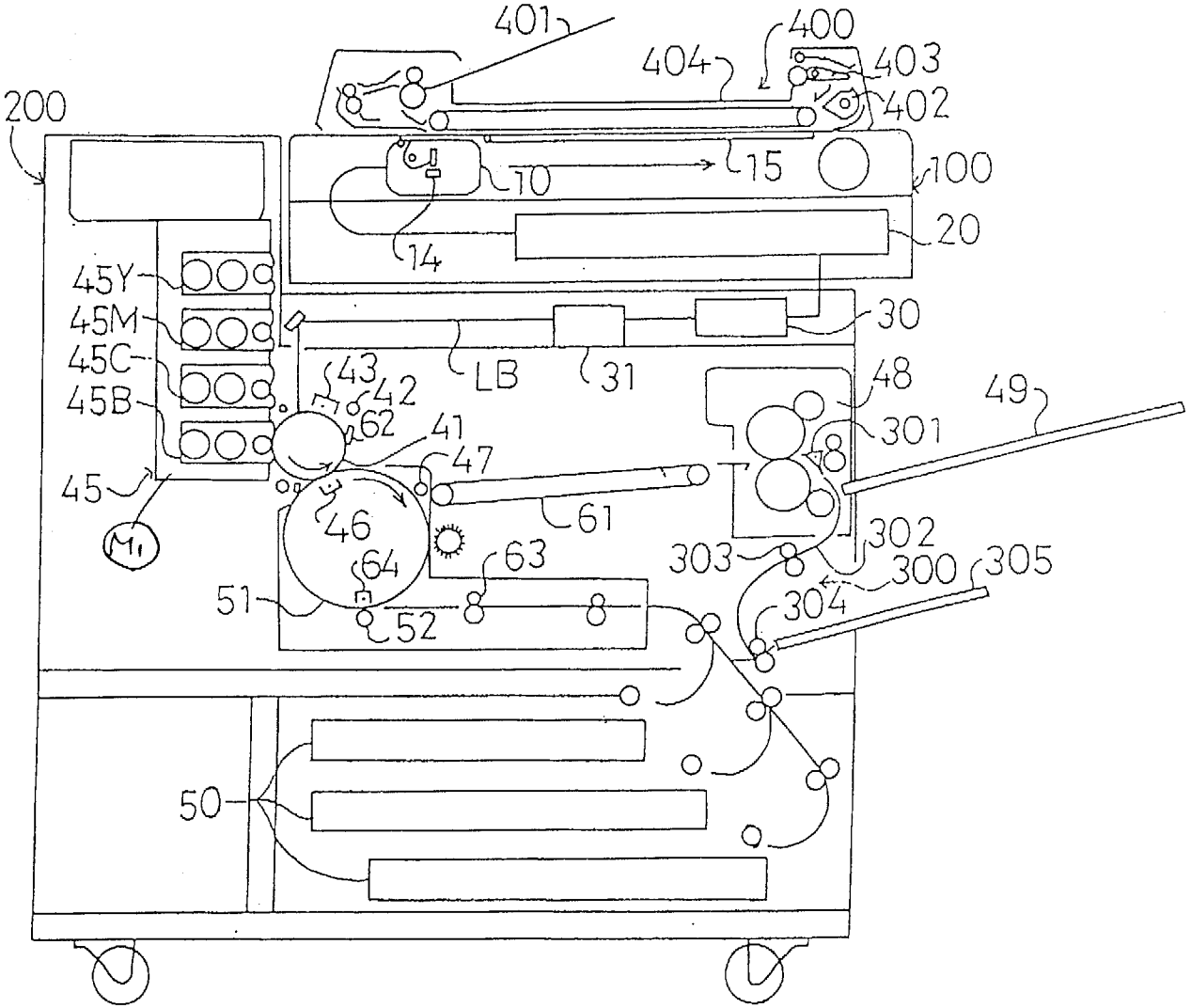
FIG. 1 shows the construction of an embodiment of the apparatus.

A preferred embodiment of the present invention is an image forming apparatus capable of printing a first image on a first surface of a sheet by an electrophotographic method and subsequently printing a second image on a second surface of said sheet by an electrophotographic method, said image forming apparatus being provided with a detection means for detecting the amount of adhered toner on a first surface of a sheet based on a first image, a setting means for setting the transfer output of when transferring a second toner image to a second surface of said sheet based on the amount of adhered toner detected by said detection means, and a transfer means for electrostatically transferring a toner image to a sheet by said set transfer output.

Another preferred embodiment of the present invention is an image forming apparatus capable of printing a first image on a first surface of a sheet by an electrophotographic method and subsequently printing a second image on a second surface of said sheet by an electrophotographic method, said image forming apparatus being provided with a detection means for detecting the amount of adhered toner on a first surface of a sheet based on a first image, a carrying means for adhering and transporting a sheet to a printing process, setting means for setting an adhesion output when adhering a sheet to said sheet carrying means for printing on a second surface of said sheet based on the amount of adhered toner detected by said detection means, and an adhesion means for electrostatically adhering a sheet to said sheet carrying means by a set output.

Still another preferred embodiment of the present invention is an image forming apparatus of the invention as described above, wherein said detection means detects information corresponding to an amount of adhered toner based on the ratio of the adhered toner region and background region (black/white ratio) of a first image.

In the above embodiments, a first image and a second image may be image data input or transmitted from an image reader (image forming apparatus), or a drive device such as personal computer, network (LAN), mass storage media (CD, MO, WO, FD, HD or the like), or may be images drawn on a document sheet. That is, the image forming apparatus of the present invention may be adapted for use with a color printer, monochrome printer, color facsimile apparatus, monochrome facsimile apparatus, digital color copier, digital monochrome copier, analog color copier or analog monochrome copier insofar as such apparatuses use an electrophotographic method and are provided with a duplex printing function.

When a first image comprises digital image data, a method of detecting information corresponding to an amount of adhered toner from said image data may be, for example, a method wherein data expressing the gradient of each pixel (e.g., 8-bit data of 256 gradients) of all areas are added. In this case, when the ratio of adhered toner region to the background region (i.e., black/white ratio) is determined, a gradient of a certain value (e.g., the 100th gradient from pure white) is set as a boundary for calculating as background area the areas which are lighter than said gradient. Another method determines the ratio for the total number of pixels in an image by enumerating the number of pixels of adhered toner of all areas, and uses this value as the B/W ratio. This method is simple because it does not include the density of each pixel.

If a color image is a composite of toners of two or more colors, the aforesaid processes can be performed for image data of each color to determine the total value.

When a first image is an image on a document sheet, the reflected light of the image is detected by an auto exposure (AE) sensor, and the image density (ratio of adhered toner region to background region (black/white ratio)) may be used to express the amount of adhered toner. The aforesaid image data may be similarly processed when a means is provided for converting a read image to image data.

The means for setting the transfer output sets the transfer output level so as to increase the charge applied to the sheet during transfer to a second surface of said sheet when much toner is adhered to a first surface of said sheet. The transfer output level may be set at various levels (two levels, three levels or the like) with particular thresholds as boundaries, or may set so as to change consecutively. When the transfer means is a transfer charger, the amount of current to be supplied is usually set. When the transfer means is of a contact type (e.g., conductive brush, conductive roller or the like), the value of the voltage to be supplied is usually set. Electrostatic transfer is a method wherein toner is attracted by means of a charge supplied to the sheet. Although the transfer of a toner image to a sheet is typically accomplished from a photosensitive member having an electrostatic latent image developed by toner, the present invention includes such transfer from an intermediate transfer member to a sheet. Intermediate transfer members are members which carry a toner image transferred from a photosensitive member in a primary transfer, and transfer said image to a sheet in a secondary transfer. Japanese Unexamined Patent Application No. HEI 3-192279, for example, discloses an apparatus provided with a transfer belt as an intermediate transfer member.

The means for setting adhesion output sets the adhesion output level so as to supply more charge to a sheet carrying means when adhering a sheet to said carrying means for a printing process on a second surface of said sheet when a large amount of toner is adhered to a first surface of said sheet. The adhesion output level may be set at various levels (two levels, three levels or the like) with particular thresholds as boundaries, or may set so as to change consecutively. When the adhesion means is an adhesion charger, the amount of current to be supplied is usually set. When the adhesion means is of a contact type (e.g., conductive brush, conductive roller or the like), the value of the voltage to be supplied is usually set. Electrostatic adhesion is a method wherein a sheet is attracted by means of a charge supplied to the sheet carrying member. The sheet carrying member may be, for example, a transfer belt, transfer drum comprising a film wrapped around a cylindrical frame or the like.

The transfer output level and adhesion output level of a first surface is normally set as a default value.

The reduction in moisture content of a sheet by the printing process of a first surface as well as the toner adhered by said process produce circumstances that make it desirable to increase the transfer output level and adhesion output level relative to the first surface when performing a transfer process or adhesion process of a second surface of the sheet. Therefore, the construction of the present invention provides that the transfer output and adhesion output levels are increased when performing a transfer process or adhesion process for a second surface of a sheet relative to said output levels for a first surface, and provides that the transfer output and adhesion output levels are increased when the amount of adhered toner on a first surface is expected to be greater than normal because the density of the image of a first surface is higher than normal.

The quantity or information corresponding to the amount of adhered toner on a first surface of a sheet is detected based on a first image. The output level of the transfer means when transferring a toner image to a second surface is set based on the aforesaid amount or information. The toner image is transferred to a second surface of the sheet by a transfer output of the set level.

The quantity of information corresponding to the amount of adhered toner on a first surface of a sheet is detected based on a first image. The output level of the adhesion means when adhering a sheet to a sheet carrying member to print on second surface is set based on the aforesaid amount or information. The sheet is adhered so as to print on a second surface by an adhesion output of the set level.

The construction of the embodiments of the present invention are described in detail hereinafter.

Figure 2:
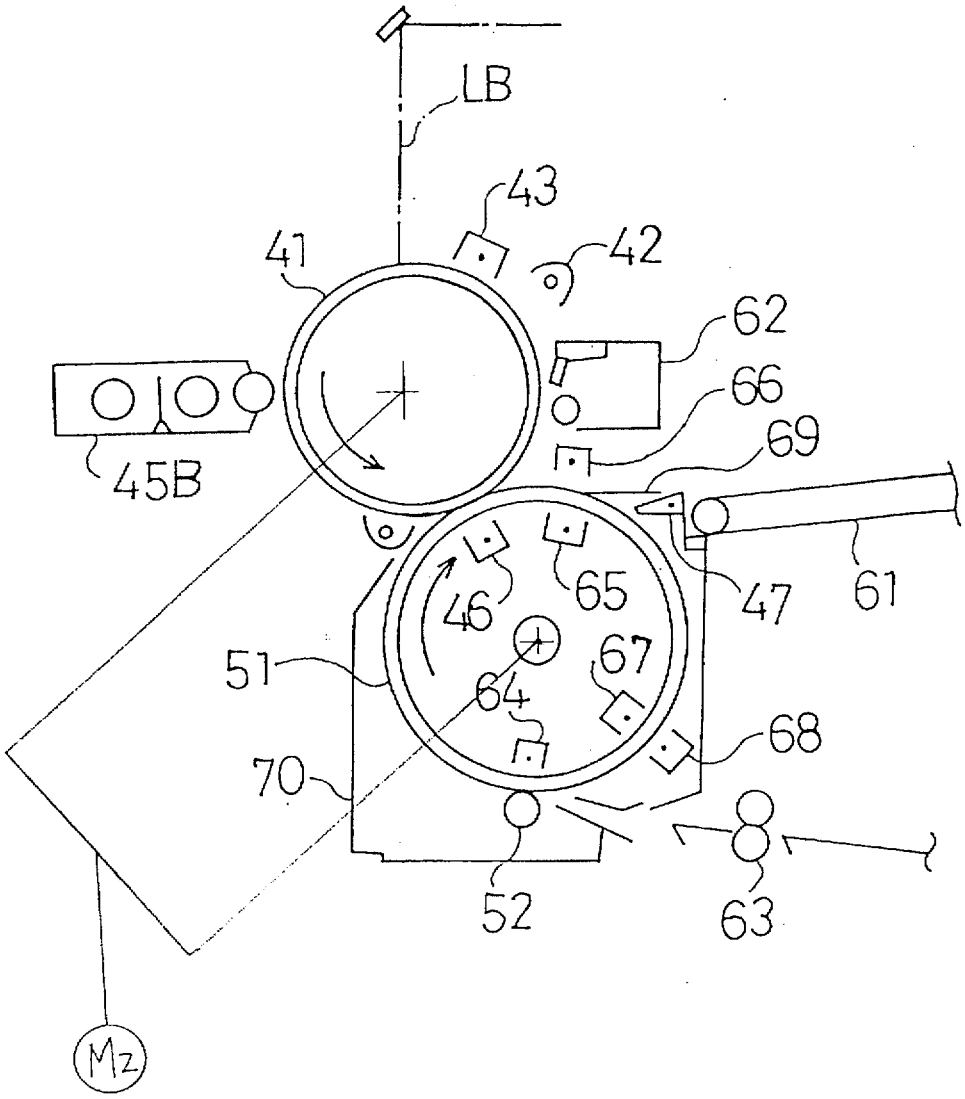
FIG. 2 shows the construction of the essential portion of an embodiment of the apparatus.

(1) Copying Apparatus Construction and Operation (FIGS. 1 and 2)

The construction and operation of the copying apparatus are described below.

The copying apparatus of the present embodiment is a digital color duplex copying apparatus. An automatic document feeder (ADF) 400 is installed above document platen 15 of the copier body.

ADF 400 feeds a document set with a first surface facing upward (e.g., first surface disposed face up, second surface face down) on a document tray 401 from the uppermost position of the document stack and transports said document to a predetermined position on document platen 15 with said first surface face down thereon, and said document remains at said predetermined position until scanning of the first image is completed; after scanning ends said document is transported in the same direction as the feeding direction (rightward direction in the drawing) to an inversion unit 402; after said document is inverted front-to-back in the inversion unit 402, it is again transported to the aforesaid predetermined position with a second surface face down thereon and remains there until scanning of a second image is completed, and thereafter said document is transported in an opposite direction to the feeding direction so as to again arrive at the inversion unit 402 and is subsequently ejected from the inversion unit 402 to a discharge tray 404 with said second surface facing upward (i.e., first surface is face down). In inversion unit 402, the switching between inverting the sheet and refeeding said sheet to document platen 15, and directly ejecting said sheet to discharge tray 404 is accomplished by switching the position of a switching member 403. The mechanism and control of the ADF 400 may be any well known mechanism and control. That is, the ADF 400 is not limited to the aforesaid device, inasmuch as, for example, a document circulation feeding type device, or a device of a type without a document inverting function may be used. Naturally, when a device of a type without a document inverting function is used, a duplex document cannot be inverted front-to-back and sequentially fed automatically.

The copying apparatus body comprises an image reader unit 100 and a printer unit 200.

The image reader unit 100 converts a document stopped at a predetermined position on document platen 15 to line-by-line electrical signals by optically scanning said document via a scanner 10, and generates image data corresponding to the document image based on said electrical signals. That is, an image of reflected light is converted to electrical signal of three colors red (r), green (g), blue (b) for each pixel via a color image sensor 14 provided in scanner 10, and said electrical signals are transmitted to an image processing unit 20 for predetermined processing. The various four color density data of yellow (Y), magenta (M), cyan (C), and black (B) generated by the aforesaid process are sequentially transmitted to a print head control unit (laser drive circuit) 30 to form an electrostatic latent image.

The print head control unit 30 converts the aforesaid density data to data to drive a laser diode, and said laser driving data are used to modulate the drive current supplied to laser diode 31. A laser beam LB emitted from the laser diode 31 driven by the modulated drive current is directed by a well known optical system provided with a polygonal mirror, so as to scan the charged surface of a rotating photosensitive drum 41 in the axial direction of said drum (a direction perpendicular to the sheet surface in the drawing). Thus, an electrostatic latent image (charged latent image) corresponding to a document image is formed on the charged surface of photosensitive drum 41. In the case of full color image formation, this electrostatic latent image is formed in sequence for each toner color, i.e., in the sequence yellow (Y), magenta (M), cyan (C), black (B). In the case of a monochrome image, an electrostatic latent image is formed in accordance with the luminance of the document image.

Image formation by an electrophotographic process is accomplished in the printer unit 200.

That is, an electrostatic latent image formed on the surface of photosensitive drum 41 is developed by toner via developing devices (45Y, 45M, 45C, or 45B) which accommodate color toner (and carrier) in accordance with said latent image, and said toner image is transferred to a sheet electrostatically adhered to the surface of a transfer drum 51. In the case of a full color image, the toner images of each color yellow (Y), magenta (M), cyan (C), and black (B) are transferred to the same sheet so as to be superimposed one upon another. After the toner image is transferred, the sheet is peeled from the transfer drum 51, and transported to fixing device 48 via a transport belt 61, and fixing device 48 accomplishes an image fixing process via heat and pressure. After the image fixing process, if the duplex copy mode (mode for forming various images on both sides of a sheet) has been set and the first surface (front side) of the sheet has been printed directly before, the sheet is fed through duplex path 300 so as to be inverted front-to-back, and thereafter said sheet is again electrostatically adhered to transfer drum 51 and the print process is performed on the second surface (back side). When a one-side mode (mode for forming an image on only one side of the sheet) or when the second surface of a sheet has been printed directly before, the sheet is ejected from the copying apparatus body to discharge tray 49. The ejection of the sheet may occur directly, or the sheet may be inverted front-to-back by switching branch wedge 301.

The various mechanisms of the printer unit 200 are described below.

Provided sequentially around the periphery of photosensitive drum 41 which rotates in the arrow direction are a charger 43 for uniformly charging the surface of photosensitive drum 41, developing unit 45 provided with four developing devices 45Y, 45M, 45C, 45B for developing via toner the electrostatic latent image formed by a laser beam LB on said uniformly charged surface, transfer drum 51 which rotates in the arrow direction and supports (via electrostatic adhesion) a sheet for receiving the transferred toner image developed by a selected developing device, cleaner 62 for removing residual toner from photosensitive drum 41, and eraser 42 for eliminating residual charge from the surface of photosensitive drum 41 via optical exposure.

The four developing devices 45Y, 45M, 45C, 45B accommodate yellow (Y), magenta (M), cyan (C), and black (B) toner, respectively. These developing devices are sequentially selected, the selected developing device is set at a developing position, and the latent image formed on the surface of photosensitive drum 41 is sequentially developed as a toner image in accordance with the toner color within said developing device. Developing device selection is accomplished by elevating developing unit 45 via a motor M1. In the drawing, developing device 45B which accommodates black toner (B) has been selected. In the present embodiment, developing unit 45 is an elevator type device, but a rotary or other type device may be used.

Transfer drum 51 is rotated in the arrow direction in synchronization with photosensitive drum 41, as shown in FIG. 2. The diameter ratio of photosensitive drum 41 to transfer drum 51 is 1:2. The reason for this ratio is to prevent the occurrence of color dislocation due to shifting of the photosensitive drum 41, shifting of transfer drum 51, or variation in the engagement of gears. That is when constructed with the aforesaid diameter ratio, transfer shifting occurs identically for each color toner even when the aforesaid shifting or oscillation occurs, such that color dislocation is prevented as a result. When constructed with the aforesaid diameter ratio and when the full color mode is selected, a one-sided copy can be obtained in four rotations of the transfer drum 51 and 8 rotations of the photosensitive member 41. The rotation of the transfer drum 51 and photosensitive drum 41 is accomplished by a motor M2.

A dielectric film having a thickness of about 150 μm is anchored to the cylindrical peripheral surface of transfer drum 51. This dielectric film may be formed of, for example, polyvinylidene fluoride (PVDF), polycarbonate (PC) or the like.

The interior and vicinity of transfer drum 51 is provided with an adhesion charger 64 for supplying a positive charge to electrostatically adhere a sheet, grounded conductive roller 52 provided so as to hold the film on the surface of transfer drum 51 at a position opposite said charger 64, transfer drum support frame 70 provided so as to be rotatable about a shaft 47 so as to normally maintain a distance of 0.1 to 0.5 mm between transfer drum 51 and photosensitive drum 41, transfer charger 46 for supplying a charge to electrostatically transfer a toner image from the surface of photosensitive drum 41 to a sheet, separation chargers 65 and 66 for discharging the charge which adheres the sheet, separation member 69 for separating the leading edge of the sheet from transfer drum 51, a cleaner for the exterior surface of transfer drum 51, and dischargers 67 and 68 for discharging the residual charge remaining on the interior and exterior surfaces of transfer drum 51 by an AC output. The aforesaid separation charger 65 functions to diminish the electrostatic adhesion force of the sheet and the dielectric film by an AC output the aforesaid separation charger 66 functions to prevent airborne dispersion of the transferred toner image by discharging the sheet and preventing discharge in accordance with separation when the sheet is separated from transfer drum 51.

Figure 3:
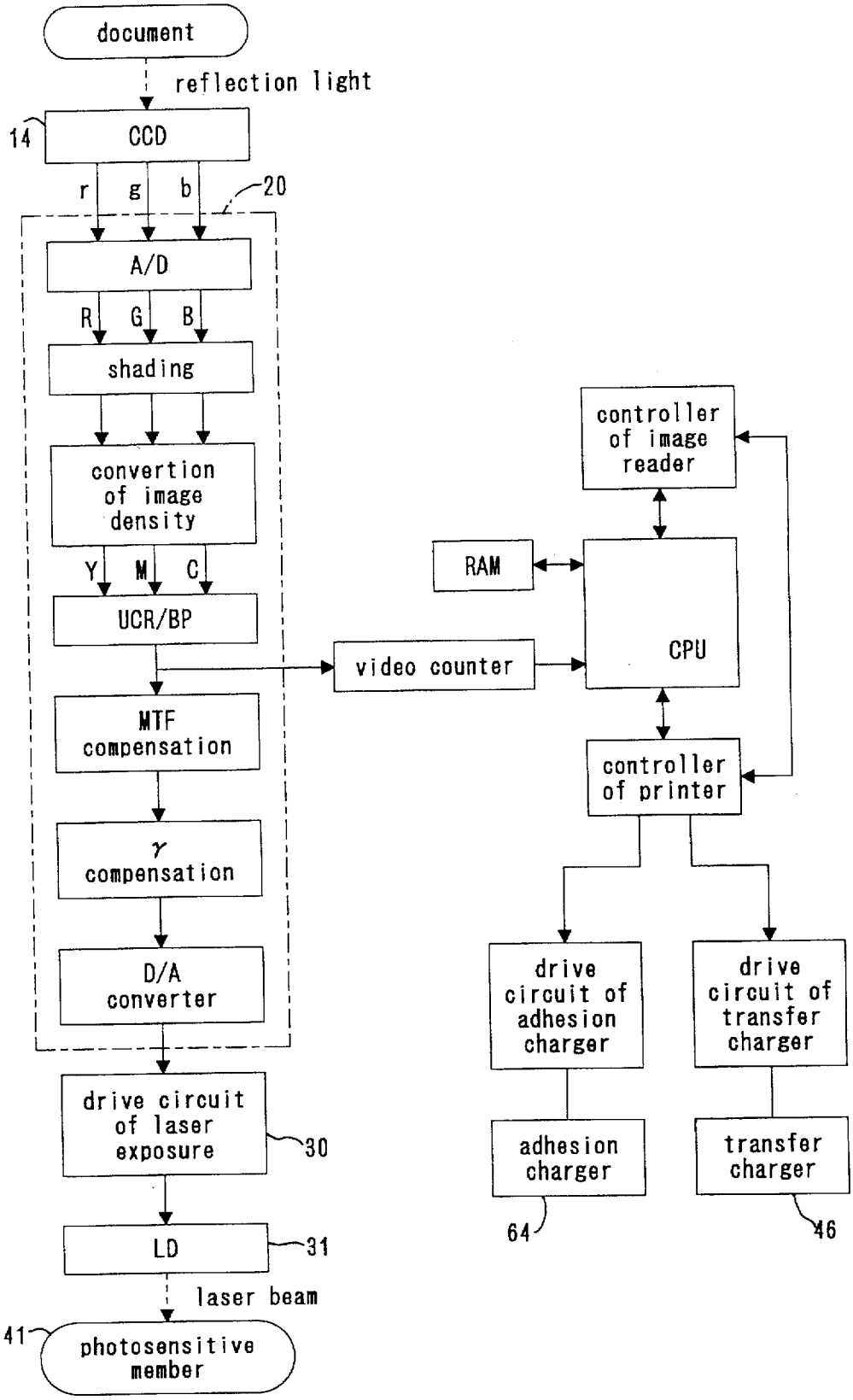
FIG. 3 is a block diagram showing the essential part of the electrical construction of an embodiment of the apparatus.

During the image forming operation, a sheet output from one of three sheet trays 50 arrives at timing roller 63, and forms a loop while in contact with said timing roller 63 so as to correct skewing of the sheet. Thereafter, in synchronization with photosensitive drum 41, the sheet is fed between adhesion charger 64 which is connected to an HV circuit (high voltage power circuit; FIG. 3) and the grounded conductive roller 52 which confronts charger 64, so as to be held between said roller 52 and the surface (dielectric film) of transfer roller 51 and electrostatically adhered to said dielectric film. The output of adhesion charger 64 is a normal value when adhesion is for printing a first surface of a sheet, and is a higher value than for said first surface when adhesion is for printing a second surface of said sheet, as shown in FIG. 5. Furthermore, an even higher value is used for adhesion than for said second surface when a sheet is adhered for printing a second surface and the image on a first surface has a greater than normal amount of toner, as shown in the righthand column of FIG. 5.

The sheet is transported in the arrow direction while adhered to transfer drum 51, and when said sheet arrives at the transfer position (a position between transfer charger 46 and photosensitive drum 41), a transfer charge is supplied to the sheet on the surface of transfer drum 51 from transfer charger 46 connected to the transfer HV circuit (high voltage power circuit; FIG. 3). Thus, the toner image developed on the photosensitive drum 41 by one or more of the four developing devices 45Y, 45M, 45C, or 45B is electrostatically transferred to the sheet. During this transfer, the output value of transfer charger 46 is a preset normal value so as to be sequentially increased for each successive toner image when transferring to a first surface. When transferring to a second surface, the output value of transfer charger 46 is greater than the various values for transfers to said first surface. Furthermore, an even higher value is used for transfer than for said second surface when a sheet is adhered for printing a second surface and the image on a first surface has a greater than normal amount of toner, as shown in the righthand column of FIG. 5.

In the case of color printing, the four toner images of yellow (Y), magenta (M), cyan (C), and black (B) must be combined, such that each time the sheet arrives at the previously mentioned transfer position, a toner image of a selected color is formed on the surface of photosensitive drum 41, and said toner image is transferred to the sheet as previously described. In this example, the yellow (Y) toner image is the first to be transferred.

After the yellow (Y) toner image has been transferred, the sheet is rotated together with the transfer drum 51 while adhered to said transfer drum 51 so as to pass the positions of the non-operating separation chargers 65 and 66, non-operating (retracted position) separation member 69, non-operating (non-contact) cleaner, non-operating dischargers 67 and 68, and non-operating adhesion charger 64 and arrive again at the transfer position. The reason the aforesaid components are in a non-operating (non-contact) state, is to avoid disturbing the yellow (Y) toner image previously transferred to the sheet. The conductive roller 52 disposed at a position confronting adhesion charger 64 is originally in a state of non-contact, and poses no threat of disturbing the transfer image.

This time when the sheet returns to the transfer position a magenta (M) toner image is transferred and combined with the aforesaid yellow (Y) toner image. Thereafter, the sheet is again transported in rotation as previously described until again arriving at the transfer position, whereupon a cyan (C) toner image is transferred to the sheet, then the sheet is again transported in rotation until again arriving at the transfer position, whereupon a black (B) toner image is transferred to the sheet in a similar manner.

When the transfer and combination of the toner images of the four colors ends, the sheet adhered to the transfer drum 51 is separated therefrom by weakening the electrostatic adhesion force via discharges from separation chargers 65 and 66, and the sheet is separated from transfer drum 51 by separation member 69, transported to fixing device 48 by transport belt 61, and subjected to a thermal fixing process.

After the image fixing process, if a one-side mode or if the second surface of a sheet has been printed directly before, the sheet is ejected from the copying apparatus body to discharge tray 49 guided by the top surface of branch wedge 301 set as shown in the drawing. Branch wedge 301 can be switched so as to guide the sheet by the left surface of said wedge 301 in the drawing into duplex path 302, and thereafter branch wedge 301 is again switched in conjunction with the reversal of the rotation direction of transport roller 303 so as to guide the sheet with the right surface of said wedge 301 in the drawing, thus controlling the ejection of the sheet from the apparatus to discharge tray 49. In this case, the sheet is inverted front-to-back when discharged.

On the other hand, when a first surface of a sheet has been printed directly before and a duplex copy mode has been set, the sheet is guided by the left surface of branch wedge 301 which has been switched from the position illustrated in the drawing, so as to be inserted into duplex path 302 and arrive at inversion tray 305 via transport roller 303 and inversion roller 304. The rotational direction of inversion roller 304 is reversed directly before the trailing edge of the sheet passes thereby, such that the sheet is fed into the sheet transport path leading to the aforesaid timing roller 63. At this time, the sheet is reversed front-to-back. The sheet is again electrostatically adhered to transfer drum 51 and this time the transfer process is performed on the second surface of the sheet.

(2) Image Processing (FIG. 3)

The processing performed by image processing unit 20 is described below.

Various r-g-b image signals converted from electrical signal read by color image sensor (CCD) 14 are converted to yellow (Y), magenta (M), cyan (C), and black (B) density data by image processing unit 20, and sequentially transmitted to laser control unit 30. Image processing unit 20 is provided with an A/D converter, shading correction unit, density conversion unit, UCR/BP unit, MTF correction unit, gamma correction unit, and D/A converter.

The red (r), green (g), and blue (b) image signals received from CCD 14 by the A/D converter are converted to 8-bit (256 halftones) image data (red R, green G, blue B). These image data are subjected to shading correction by the shading correction unit to eliminate light quantity irregularities in the main scan direction by the exposure lamp, reflection irregularities caused by the reflection mirrors, and effects caused by sensitivity differences among the elements of CCD 14. Then, yellow (Y), magenta (M), cyan (C), and black (B) density data are generated from the red R, green G, and blue B data by the density conversion unit. That is, data corresponding to the density of a document are generated by logarithmic conversion of data corresponding to reflected light intensity of a document per visual characteristics. Then, undercolor removal processing and BP processing for generating density data corresponding to black B are accomplished by the UCR/BP unit.

When yellow (Y), magenta (M), cyan (C), and black (B) density data are generated, these data are sequentially subjected to predetermined processing and output. That is, a smoothing process to prevent the occurrence of moire reticulation, and edge enhancing process to prevent edge loss are performed by the MTF correction unit, and after halftone correction by the gamma correction unit, the data are converted to analog density signals by the D/A converter. Thus, the laser diode 31 is driven to form electrostatic latent images corresponding to yellow (Y), magenta (M), cyan (C), and black (B) on the surface of photosensitive drum 41. Furthermore, the formed electrostatic latent images are subjected to the previously described developing process to as to be developed as toner images, which are adhered to transfer drum 51 and moved to a transfer position at which the toner image is transferred to the sheet.

Figure 4:
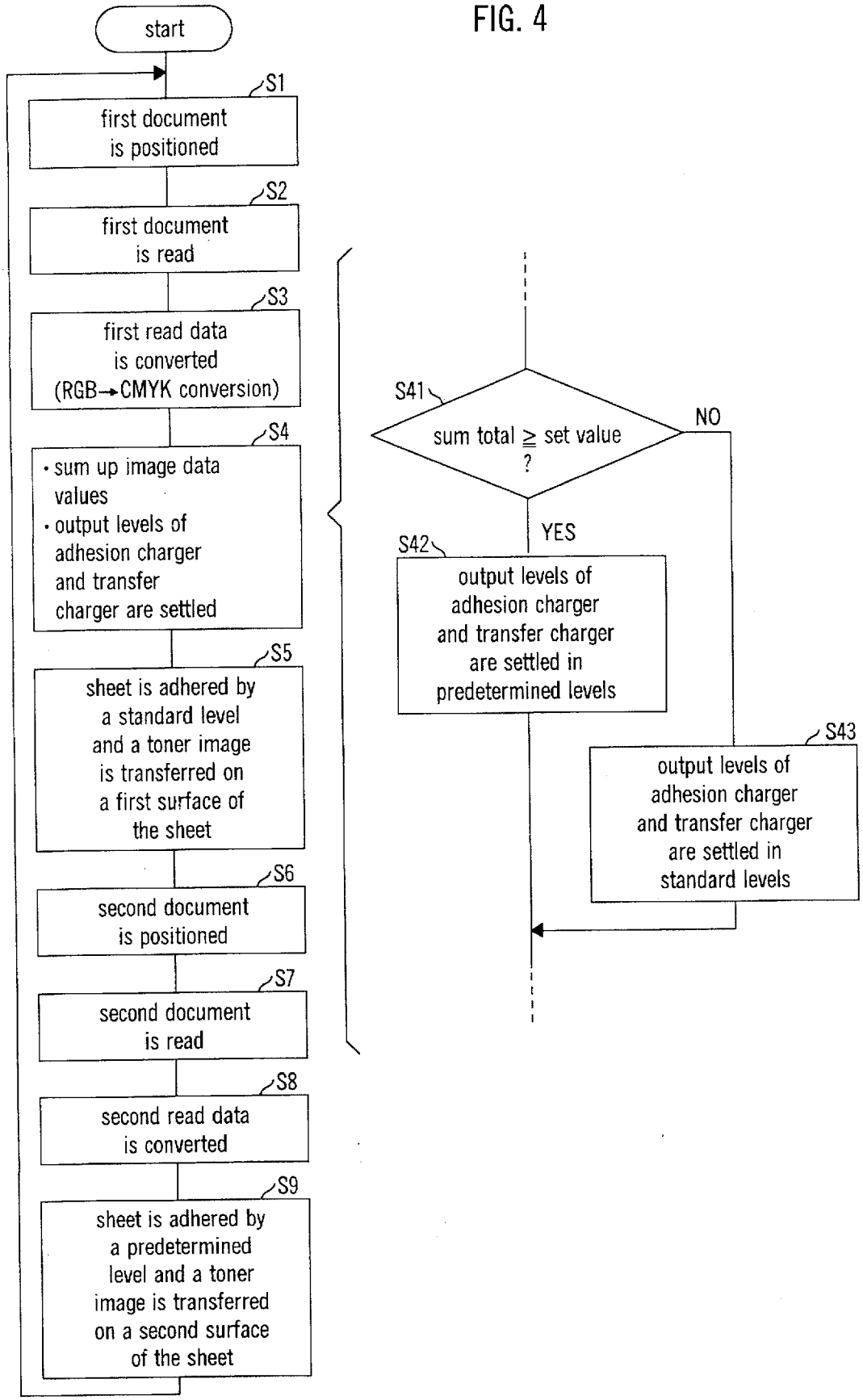
FIG. 4 is a flow chart describing the elements of the operation of an embodiment of the apparatus.

(3) Duplex Copy Process (FIG. 4)

The sequence of the duplex copy process is described below. The duplex copy process is a process for copying on a second surface of a sheet, and although the sequence of a normal copy process is executed for each copy process, the main points of the duplex copy process are described relative to said sequence.

When a duplex document is set on document tray 401 of ADF 400 and a color duplex copy command is issued via key input from an operation panel not shown in the drawing, the uppermost document (step S1, FIG. 4) in the stack is fed from document tray 401 and transported by the ADF so as to be set at a predetermined reading position on document platen 15 (S1).

A first surface of this first document is read by image reader unit 100 (S2), and the read data is subjected to image processing by image processing unit 20. That is, said read data are converted to RGB image data, which are converted to Y, M, C, B density data (S3).

The generated Y, M, C, B density data are sequentially output as previously described, and in the present apparatus the data values (data of 8-bits =256 halftones per pixel) of the various density data are transmitted to a video counter. The video counter adds the various data values and determined the sum total within said first surface. A determination is made as to whether or not the amount of adhered toner of the image formed on the first surface of the sheet corresponding to said first surface is greater than a predetermined value based on the aforesaid sum total value, and these result of said calculation is stored in RAM memory. The output level of the transfer charger 46 when transferring a toner image to a second surface of the sheet, and the output level of the adhesion charger 64 when adhering a sheet transfer drum 51 for printing on a second surface of said sheet, are both set at suitable timings based on the aforesaid data stored in the RAM memory (S4).

For example, when the aforesaid sum total is less than a set value (S41: NO), the values in the left column of Table 1 are set as the transfer output and adhesion output for the second surface of the sheet. That is, the adhesion output is set at 100 μA, and the transfer output is set at 150 μA for a first color, 200 μA for a second color, 250 μA for a third color, and 300 μA for a fourth color (S43).

On the other hand, when the aforesaid sum total is equal to or greater than a set value (S41: YES), the values in the right column in Table 1 are set as the transfer output and adhesion output for a second surface of the sheet. That is, the adhesion output is set at 200 μA, and the transfer output is set at 250 μA for a first color, 300 μA for a second color, 350 μA for a third color, and 400 μA for a fourth color (S42).

The previously mentioned predetermined set value is the ratio of the adhered toner area and background area in an image, i.e., black/white area (size) ratio, and is a ratio of 30%. Since the present example, is a color image combining toner images of two or more colors, after the sum total density data of all colors in the image is determined, the sums of the four color components are determined. The aforesaid B/W ratio can be readily determined by calculating the number of pixels of adhered toner, and comparing said value to the total number of pixels in the image. In this case, the process is quite simple because no consideration is given to halftone pixels.

Then, a copying process is executed for a first surface (front side) of a first sheet fed from paper tray 50 and wrapped around transfer drum 51 (S5). In this case, the values shown in Table 1 are used as the output level of transfer charger 46 and output level of adhesion charger 64. That is, the adhesion output level is at 50 μA, and the transfer output level is set at 100 μA for a first color, 150 μA for a second color, 200 μA for a third color, and 250 μA for a fourth color. These values are predetermined standard (default) values. Although the density data obtained based on the reading process of step S2 may be used as the density data for forming a first image on a first surface of a sheet (i.e., data transmitted from image processing unit 20 to laser drive circuit 30), the image reader unit 100 may be controlled so as to read a first image for step S5 as a prescan for step S2.

When a first document is copied to a first surface of a sheet, a second document (in the present example, the second document is the back side (second surface) of a single page document) is set on document platen 15 (S6). That is, after a document on document platen 15 is transported in a rightward direction in the drawing and inverted by inversion unit 402, said document is again set at the predetermined reading position on document platen 15. At this time, after the first sheet which has been copied to a first surface is transported to duplex path 300 and inverted front-to-back, said sheet is wrapped around transfer drum 51 as previously described, but the output of adhesion charger 64 at this time is set at a value depending on whether or not the amount of adhered toner of the image formed on a first surface of said sheet is equal to or greater than a predetermined set value.

Then, a second document is read (S7), the obtained image signals are transmitted to image processing unit 20 and subjected to image processing, and subsequently output to laser drive circuit 30. (S8). Step S7 is identical to step S2, and step S8 is identical to step S3, and details of these steps therefore are not described in detail.

When the second document is subjected to image processing, a copying process is executed for a second surface (back side) of a first sheet wrapped around transfer drum 51 (S9). That is, after toner images of four colors are sequentially transferred, and subjected to a fixing process, the sheet is ejected outside the apparatus to discharge tray 49. The output of transfer charger 46 at this time is set at a value depending on whether or not the amount of adhered toner of the image formed on a first surface of said sheet is equal to or greater than a predetermined set value.

In this manner, when a first image (front side) of a first page of a document is copied to a first surface (front side) of a first sheet and a second image (back side) of a first page of a document is copied to a second surface (back side) of a first sheet, similar processing is executed relative to the second page of a document and a second sheet (returning now to the initial step of FIG. 4), and identical processing is repeated until no documents remain in document tray 401 of ADF 400.

Although the embodiments above have been described in terms of a full color digital copying apparatus for copying color duplex documents, the present invention is not limited to these examples and may be applied to other developments such as described below.

For example, the first and second images may be images printed on different documents.

Furthermore, a first image and a second image may be image data input or transmitted from an image reader (image forming apparatus), or a drive device such as personal computer, network (LAN), mass storage media (CD, MO, WO, FD, HD or the like), or may be images drawn on a document sheet. That is, the image forming apparatus of the present invention may be adapted for use a color printer, monochrome printer, color facsimile apparatus, monochrome facsimile apparatus, digital color copier, digital monochrome copier, analog color copier or analog monochrome copier insofar as such apparatuses use an electrophotographic method and are provided with a duplex printing function.

When the apparatus is an analog copying apparatus and image data and density data cannot be obtained, the amount of reflected light from an image of a first document may be detected by auto exposure (AE) sensor, and the detected image density (ratio of adhered toner area and background area; black/white ratio) may be used as the amount of adhered toner of a first image.

Although the set levels of transfer output and adhesion output related to printing a second surface have been described as two-level settings in the present embodiment, it is to be noted that three or more levels may be used, or levels may be changed consecutively. The previously described embodiment uses a transfer charger 46 and adhesion charger 64, but contact-type means for imparting a charge, such as a transfer brush and adhesion brush may alternatively be used. Furthermore, although the aforesaid embodiment has been described by way of transference from a photosensitive drum to a sheet, the present invention may be applied to apparatuses of types which transfer a toner image from a photosensitive drum to an intermediate transfer member, and transfer said toner image from the intermediate transfer member to a sheet.

The transfer output level to a second surface is controlled based on the amount of adhered toner on a first surface in the present embodiment. Therefore, when transferring a toner image to a second surface, said transfer is accomplished by an optimum output by considering variation of electrostatic capacity caused by the print process to a first surface, thereby preventing the problem of inadequate toner transfer, and disruption of the transferred toner image.

The adhesion output level when adhering a sheet for printing a second surface is controlled based on the amount of adhered toner on a first surface in the aforesaid embodiment. Therefore, when adhering a sheet to a sheet carrying member for printing a second surface, adhesion is accomplished by an optimum output by considering the degree of curling of the sheet caused by the printing process performed on a first surface of the sheet, thereby preventing inadequate adhesion. Thus, stable sheet transport is possible, which results in the production of excellent images without image transfer position dislocation.

The present invention is not limited to the previously described embodiments and may be variously modified by those skilled in the art insofar as such modifications do not depart from the scope of the invention.

TABLE 1

| | Amt. Adhered toner 1st surface (B/W ratio) | |
|---|---|---|
| | Less than 30% | 30% or more |
| 1st surface adhesion output (μA) | 50 | 50 |
| 1st surface transfer output (μA) | | |
| 1st color | 100 | 100 |
| 2nd color | 150 | 150 |
| 3rd color | 200 | 200 |
| 4th color | 250 | 250 |
| 2nd surface adhesion output (μA) | 100 | 200 |
| 2nd surface transfer output (μA) | | |
| 1st color | 150 | 250 |
| 2nd color | 200 | 300 |
| 3rd color | 250 | 350 |
| 4th color | 300 | 400 |

What is claimed is:

1. An image forming apparatus comprising:

first forming means for forming a first toner image on a first surface of a sheet;

second forming means for forming a second toner image on a second surface of the sheet;

detecting means for detecting the amount of adhered toner on the first surface of the sheet;

setting means for setting a forming output according to the amount of adhered toner detected by the detecting means; and inputting means for inputting the forming output to the second forming means in order to form the second toner image by the forming output.

2. The image forming apparatus of claim 1 wherein the detecting means detects an area ratio of a toner adhered area to a toner non-adhered area in order to judge the amount of adhered toner.

3. An image forming apparatus comprising:

first forming means for forming a first toner image on a first surface of a sheet;

second forming means for forming a second toner image on a second surface of the sheet;

detecting means for detecting the amount of adhered toner on the first surface of the sheet;

setting means for setting a forming output according to the amount of adhered toner detected by the detecting means; and inputting means for inputting the forming output to the second forming means in order to form the second toner image by the forming output;

wherein the setting means sets the forming output so that the second forming means makes the amount of the second toner image larger than that of the first toner image, when the detected amount of adhered toner on the first surface of the sheet is larger than a predetermined value.

4. An image forming apparatus comprising:

first forming means for forming a first toner image on a first surface of a sheet which is adhered on a carrying member by a first adhering power;

second forming means for forming a second toner image on a second surface of the sheet which is adhered on the carrying member by a second adhering power;

detecting means for detecting the amount of adhered toner on the first surface of the sheet;

setting means for setting an adhering output according to the amount of adhered toner detected by the detecting means; and inputting means for inputting the adhering output to the second forming means in order to settle the second adhering power according to the adhering output.

5. The image forming apparatus of claim 4 wherein the detecting means detects an area ratio of a toner adhered area to a toner non-adhered area in order to judge the amount of adhered toner.

6. The image forming apparatus of claim 4 wherein the setting means sets the adhering output so that the second forming means makes the second adhering power larger than the first adhering power, when the detected amount of adhered toner on the first surface of the sheet is larger than a predetermined value.

7. A image transfer device comprising:

first transferring means for transferring a first toner image from a image carrying member to a first surface of a sheet by a first transfer power;

second transferring means for forming a second toner image from the image carrying member to a second surface of the sheet by a second transfer power;

detecting means for detecting the amount of adhered toner on the first surface of the sheet;

setting means for setting a transferring output according to the amount of adhered toner detected by the detecting means; and inputting means for inputting the transferring output to the second transferring means in order to transfer the second toner image by the transferring output.

8. The image transfer device of claim 7 wherein the detecting means detects an area ratio of a toner adhered area to a toner non-adhered area in order to judge the amount of adhered toner.

9. The image transfer device of claim 7 wherein the setting means sets the transferring output so that the second transferring means makes the second transfer power larger than the first transfer power, when the detected amount of adhered toner on the first surface of the sheet is larger than a predetermined value.

10. An image transfer device comprising:

first forming means for forming a first toner image on a first surface of a sheet which is adhered on a carrying member by a first adhering power;

second forming means for forming a second toner image on a second surface of the sheet which is adhered on the carrying member by a second adhering power;

detecting means for detecting the amount of adhered toner on the first surface of the sheet;

setting means for setting an adhering output according to the amount of adhered toner detected by the detecting means; and inputting means for inputting the adhering output to the second forming means in order to settle the second adhering power according to the adhering output.

11. The image forming apparatus of claim 10 wherein the detecting means detects an area ratio of a toner adhered area to a toner non-adhered area to judge the amount of adhered toner.

12. The image forming apparatus of claim 10 wherein the setting means sets the adhering output so that the second forming means makes the second adhering power larger than the first adhering power, when the detected amount of adhered toner on the first surface of the sheet is larger than a predetermined value.

13. An image forming method comprising the steps of:

first forming a first toner image on a first surface of a sheet;

second forming a second toner image on a second surface of the sheet;

detecting the amount of adhered toner on the first surface of the sheet;

setting a forming output according to the amount of adhered toner detected by the detecting means; and inputting the forming output to the second forming means in order to form the second toner image by the forming output.

14. An image forming method comprising the steps of:

first forming a first toner image on a first surface of a sheet which is adhered on a carrying member by a first adhering power;

second forming a second toner image on a second surface of the sheet which is adhered on the carrying member by a second adhering power;

detecting the amount of adhered toner on the first surface of the sheet;

setting an adhering output according to the amount of adhered toner detected by the detecting means; and inputting the adhering output to the second forming means in order in order to settle the second adhering power according to the settled adhering output.

* * * * *